US006273827B1

(12) United States Patent
Hockerson et al.

(10) Patent No.: US 6,273,827 B1
(45) Date of Patent: Aug. 14, 2001

(54) GOLF PUTTER HEAD

(76) Inventors: Stan Hockerson, 6718 Mossman Pl. NE., Albuquerque, NM (US) 87110; Thomas C. Lynch, 76 Rte. 97, Barryville, NY (US) 12719

( * ) Notice: Subject to any disclaimer, the term of this patent is extended or adjusted under 35 U.S.C. 154(b) by 0 days.

(21) Appl. No.: 09/402,746

(22) PCT Filed: Mar. 16, 1990

(86) PCT No.: PCT/US98/05195

§ 371 Date: Oct. 12, 1999

§ 102(e) Date: Oct. 12, 1999

(87) PCT Pub. No.: WO98/44997

PCT Pub. Date: Oct. 15, 1998

Related U.S. Application Data

(60) Provisional application No. 60/043,123, filed on Apr. 10, 1997.

(51) Int. Cl.[7] ..... A63B 53/04; A63B 69/36

(52) U.S. Cl. ..... 473/236; 473/332; 473/340; 473/342; 273/DIG. 8

(58) Field of Search ..... 473/324, 313, 473/251, 236, 340, 341, 349, 347, 348, 329, 332, 350, 342; 273/DIG. 8, DIG. 4, DIG. 23

(56) References Cited

U.S. PATENT DOCUMENTS 4,422,638 12/1983 Tucker .
5,083,778 1/1992 Douglass .

FOREIGN PATENT DOCUMENTS 2173407 4/1985 (GB) .

*Primary Examiner*—Sebastiano Passaniti
(74) *Attorney, Agent, or Firm*—Richard E. Backus

(57) ABSTRACT

A putter head includes a main body with a front face upon which is carried a resilient ball-striking pad. The pad comprises a fibrous material having a resiliency so that impact forces when the head strikes a ball are elastically absorbed while imparting an optimum kinetic feel to the user. The fibrous material also produces an optimum reaction force against the ball for propelling it outwardly from the putter head. Certain embodiments provide for recessing the pad in the face of the head for providing a backing layer between the pad and recess, and for releasably attaching the pad to the face.

5 Claims, 3 Drawing Sheets

GOLF PUTTER HEAD

CROSS-REFERENCE TO RELATED APPLICATION

This is a continuation-in-part of provisional patent application serial No. 60/043,123 filed Apr. 10, 1997.

BACKGROUND OF THE INVENTION

1. Field of the Invention

This invention relates in general to golf putter heads.

2. Description of the Related Art

Conventional putters for the sport of golf are comprised of handles attached to putter heads having front faces made of hard materials such as metal, wood or synthetic polymers. Players using certain designs of putters having head faces made of metal often complain that they do not have a good kinematic "feel" with the club when striking the ball. Oftentimes there is an adverse reaction between the metal head faces and the golf ball dimples.

It has also been a goal of golf club designers to provide a putter which imparts good top spin to the ball for more accurate shots on the green. It would also be desirable to provide a putter which gives the player a softer feel without losing ball velocity.

Among the expedients in the prior art to achieve a better kinematic feel is to use Balata type golf balls which have a softer cover on them. Putter heads having inserts of polymer materials have also been tried in an effort to achieve a better kinematic feel, but with limited success.

The need has therefore been recognized for a putter head which obviates the foregoing and other limitations and disadvantages of the prior art putters. Despite the various putter designs in the prior art, there has heretofore not been provided a suitable and attractive solution to these problems.

OBJECTS AND SUMMARY OF THE INVENTION

It is a general object to provide a new and improved putter head which achieves a better kinematic feel on the club when striking the ball.

Another object is to provide a putter head of the type described having a front face with a resiliency which is sufficient to impart a desirable kinematic feel to the user when striking the ball.

Another object is to provide a putter head of the type described having a pad of fibrous material on the front face.

The invention in summary provides a putter head which is attached to the club handle. The head has a main body with a front face which carries a ball-striking pad. The pad is comprised of a fibrous material with a predetermined resiliency which is sufficient to absorb impact forces when striking a golf ball. During ball strike the head and pad impart a desirable kinematic feel to the user while also produce a propelling reaction force against the ball.

The foregoing and additional objects and features will appear from the following specification in which the several embodiments have been set forth in detail in conjunction with the accompanying drawings.

DESCRIPTION OF THE PREFERRED EMBODIMENTS

Figure 2:
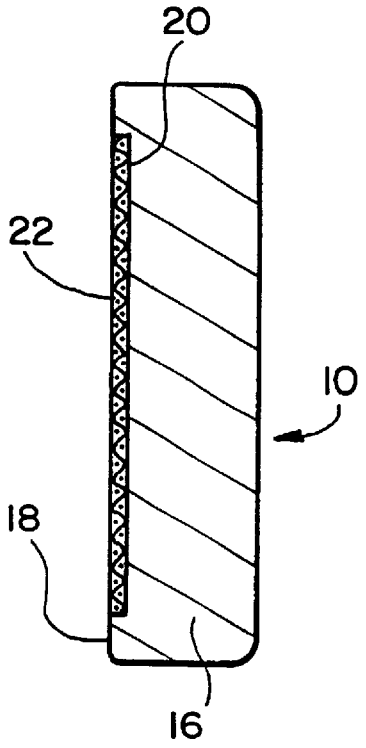
FIG. 2 is a cross sectional view to an enlarged scale taken along the line 2—2 of FIG. 1.
Figure 1:
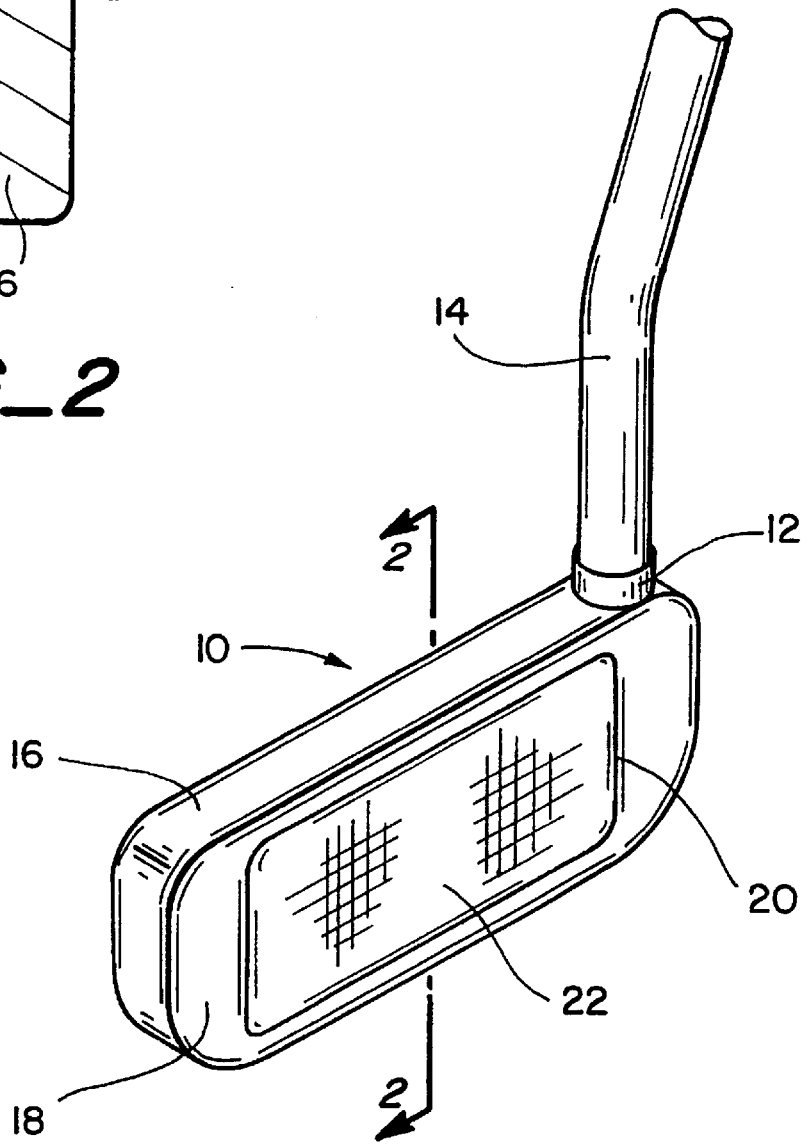
FIG. 1 is a fragmentary perspective view of a putter head in accordance with one embodiment of the invention.

In the drawings FIGS. 1 and 2 illustrate generally at 10 a putter head in accordance with one preferred embodiment of the invention. Putter head 10 is attached by a ferrule 12 to the lower end of a club handle 14.

Putter head 10 is comprised of a main body 16 formed of a suitable material such as steel, aluminum, tungsten, brass or other metals, metal alloys or non-metals which are sufficiently strong and rigid. The main body is formed with a flat front face 18 which, for a right-handed club, is on the left side of the putter head as viewed in FIG. 2. A generally rectangular recess 20 is formed in the face, and a ball-striking pad 22 is secured by suitable means such as adhesive within the recess.

Ball-striking pad 22 is comprised of a fibrous material having a resiliency which absorbs impact forces from a golf ball which is struck by the putter head. The degree of resiliency is sufficient to impart an optimum kinematic feel through the putter head and handle to the user. The resiliency is further sufficient to produce an optimum reaction force against the ball for propelling it outwardly from the putter head. For the foregoing purposes, the fibrous material of the pad is comprised of woven fibers which are selected from the group consisting of cotton, polyester, fibreglass, Kevlar® (which is a trademark for a manufactured fiber of poly(p-phenylene terephthalamide)), and a composite material comprised of carbon. One preferred example of the pad which produces optimum results is woven fibers which are a mixture of Kevlar® fibers and graphite fibers. This mixture of Kevlar® and graphite fibers results in the pad keeping its shape during usage, and it has the sufficient strength and hardness for providing the desired kinematic feel as compared to conventional putter faces made of metal and other hard materials.

In another embodiment the fibers described above are coated with a suitable silicone or urethane based material in a sufficient amount to cause the pad to have a durometer hardness measurement in the range of 86 to 88, and preferably 87. The United States Golf Association (USGA) hardness standard for putter faces is 87 durometer. This type of coating also provides waterproofing for the pad.

Figure 4:
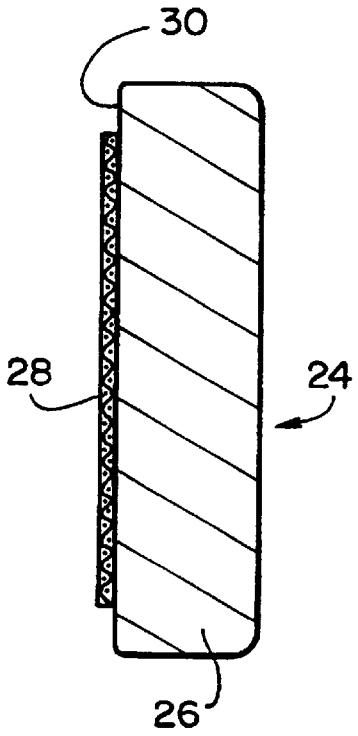
FIG. 4 is a cross sectional view to an enlarged scale taken along the line 4—4 of FIG. 3.
Figure 3:
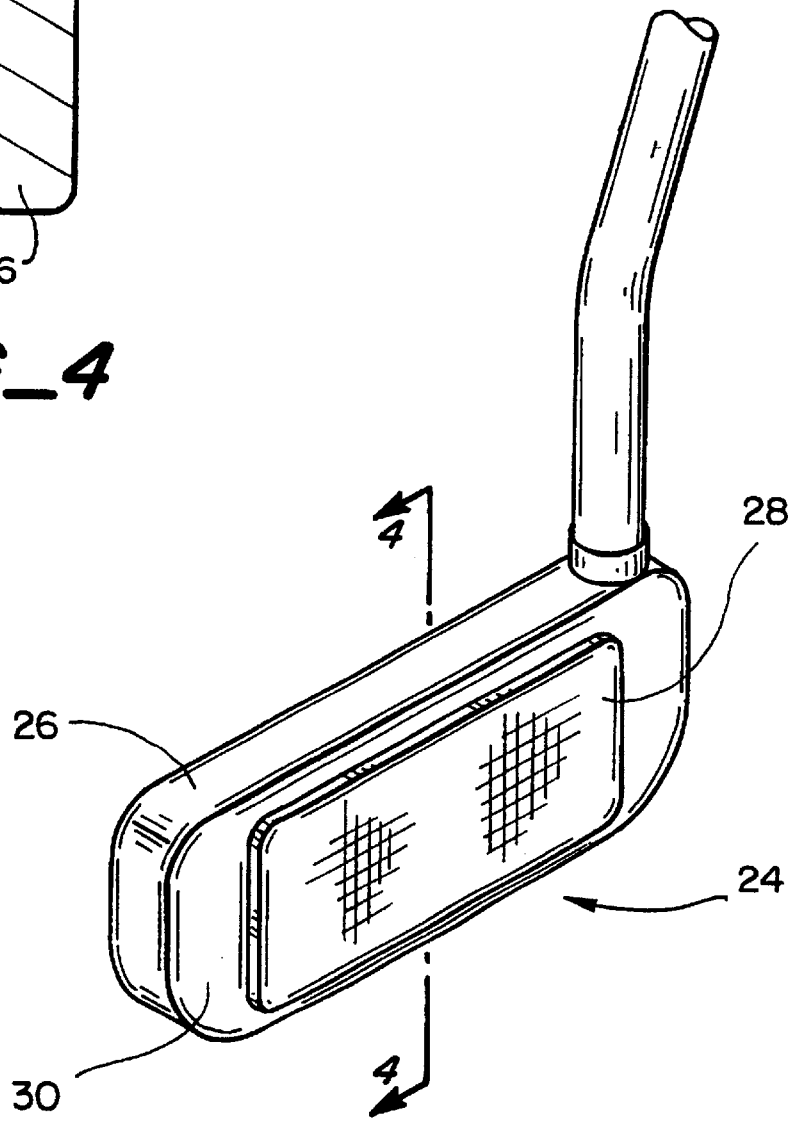
FIG. 3 is a perspective view of a putter head in accordance with another embodiment.

FIGS. 3 and 4 illustrate another embodiment providing a putter head 24 having a main body 26 and ball-striking pad 28. The pad is secured by suitable means such as adhesive across the flat front face 30 of the main body. The pad is comprised of a fibrous material as described for the embodiment of FIGS. 1 and 2.

Figure 5:
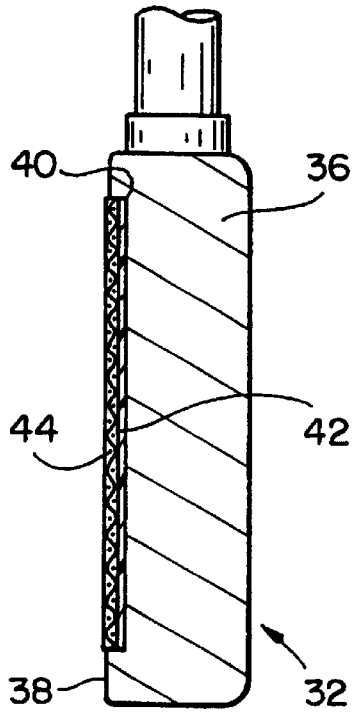
FIG. 5 is a fragmentary cross sectional view of a putter head in accordance with another embodiment.

FIG. 5 illustrates a cross section view of a putter head 32 in accordance with another embodiment. Putter head 32 is comprised of a main body 36 having a front face 38 formed with a recess 40 of generally rectangular configuration. A thin backing layer or plate 42 is secured by suitable means such as adhesive across the bottom of the recess. The backing layer can be formed of a suitable impact-resistance material such as rubber, graphite or one of the rigid synthetic polymers such as PVC. A pad 44 of fibrous material, of the type described for the embodiment of FIGS. 1 and 2, is attached by suitable means such as adhesive to the front face of the backing layer. The combined thickness of the pad and backing layer preferably is at least 1/16", (1.5875 mm). which conforms with USGA standards for putter head inserts.

Figure 6:
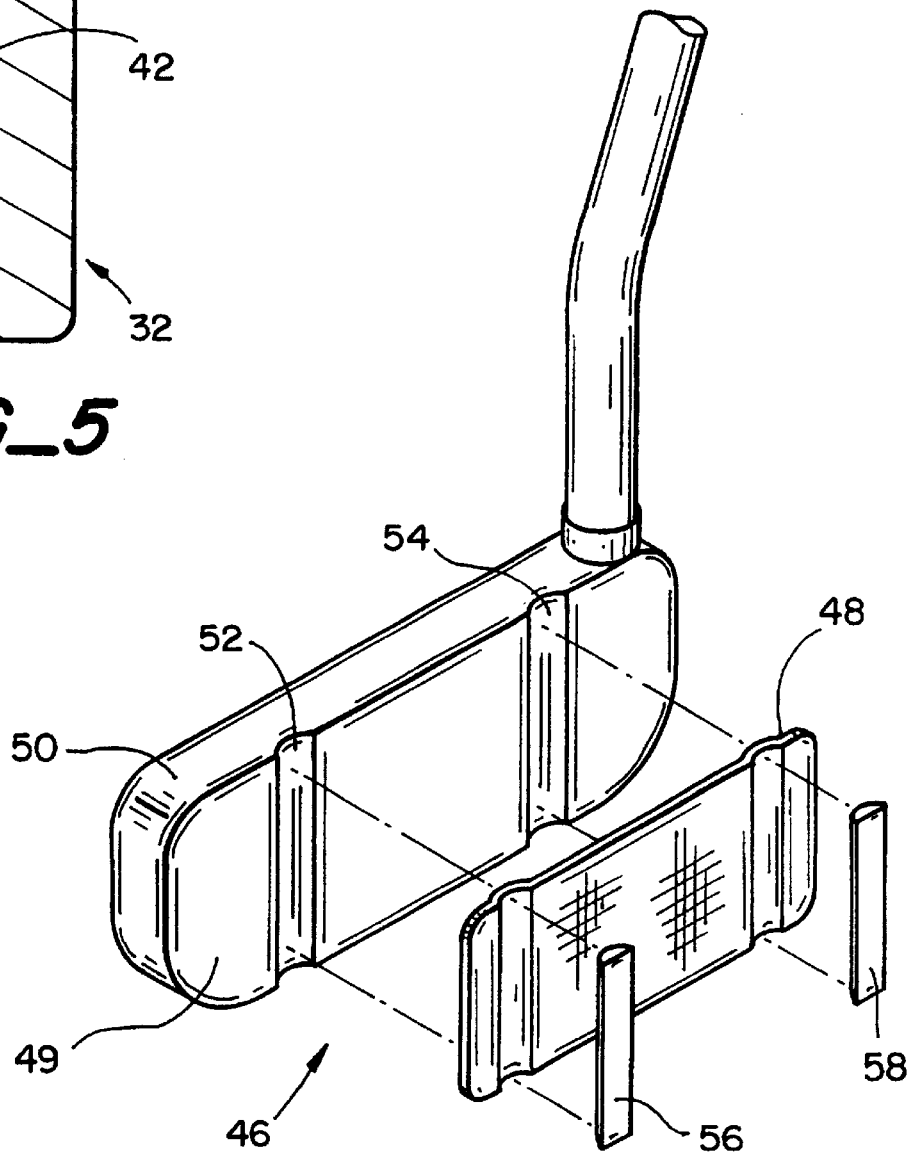
FIG. 6 is an exploded view of a putter head in accordance with another embodiment.

FIG. 6 illustrates another embodiment providing a putter head 46 having a ball-striking pad 48 which can be removably attached to the front face 49 of the head's main body 50. The front face is formed with a pair of parallel, spaced-apart semi-circular grooves 52 and 54. During assembly the pad is placed across the front face and then a pair semi-circular dowels 56 and 58 are pressed over corresponding portions of the pad, which bend down into the grooves. The upper and lower ends of the dowels are then locked in place by suitable releasable fasteners, not shown.

In use, the different embodiments of the invention provide putter heads in which the player experiences an optimum kinematic feel when stroking the ball on the green. Another advantage to the invention is that there is a better reaction of the ball when struck by the fibrous pad as compared to putters with metal faces which adversely react with the golf ball dimples. A further advantage is that the fibrous material when woven to form a cloth helps impart a top spin to the ball. Yet another advantage is that the pad of woven fibrous material imparts a softer feel without losing ball velocity. A further advantage is that the pad of fibers woven in the form of a cloth can, for purposes of aesthetics, be made of any desired color and/or be printed of suitable designs or indicia without affecting the club action.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A putter head for attaching to a club handle for a user to stroke golf balls, the putter head comprising the combination of a main body having a front face, and a ball-striking pad carried on the front face, the pad being comprised of fibers in a woven pattern, the fibers being selected from the group consisting of cotton, polyester, fiberglass, poly(p-phenylene terephthalamide) fibers and graphite, a coating of a polymer on the fibers, the polymer selected from the group consisting of silicone and urethane, the coating being applied to the fibers in an amount which is sufficient to impart to the front face a durometer hardness in the range of 86 to 88 while enabling the woven pattern to be exposed on the front face, the pad being devoid of a non-fibrous cover layer on the front face.

2. A putter head as in claim 1 in which the front face has a recess, and the pad is mounted within the recess.

3. A putter head as in claim 1 in which the pad has an outer surface, the outer surface having a coating selected from the group consisting of urethane and silicone.

4. A putter head as in claim 1 which further comprises an attachment structure for removably attaching the pad to the front face.

5. A putter head as in claim 1 which further comprises a backing layer having an outer surface, the backing layer being attached to the front face, the pad being attached to the outer surface.

* * * * *